US005415023A

United States Patent [19]

Hinson

[11] Patent Number: 5,415,023

[45] Date of Patent: May 16, 1995

[54] UNIVERSAL REPAIR RACK TRUCK TIE DOWN SYSTEM

[76] Inventor: Virgil H. Hinson, 49 Choctaw Sq., Brunswick, Ga. 31525

[21] Appl. No.: 104,891

[22] Filed: Aug. 12, 1993

[51] Int. Cl.[6] ..... B21D 1/12

[52] U.S. Cl. ..... 72/457; 72/705

[58] Field of Search ..... 72/457, 705

[56] References Cited

U.S. PATENT DOCUMENTS

| | | | |
|---|---|---|---|
| 2,482,738 | 9/1949 | Smith | 153/32 |
| 3,034,563 | 5/1962 | Gaspar et al. | 153/32 |
| 3,631,705 | 1/1972 | McCaffrey | 72/293 |
| 3,818,750 | 6/1974 | Ballweber | 72/705 |
| 4,138,876 | 2/1979 | Chisum | 72/457 |
| 4,236,400 | 12/1980 | Specktor | 72/461 |
| 4,344,314 | 8/1982 | Aldrich et al. | 72/705 |
| 4,505,145 | 3/1985 | Bergstrom et al. | 72/457 |
| 4,815,719 | 3/1989 | Peters | 72/705 |
| 5,239,854 | 8/1993 | Hinson | 72/457 |

*Primary Examiner*—Lowell A. Larson
*Attorney, Agent, or Firm*—Jacobson, Price, Holman & Stern

[57] ABSTRACT

An upright stand including a horizontally enlarged base is provided for support from a treadway of a vehicle repair rack and structure is provided for rigid securement of the base of the stand to the treadway in adjusted position shifted both longitudinally of the treadway and transversely thereof, as desired. The stand is adjustable in height and the upper end thereof includes a clamp head downwardly against which a vehicle frame member may be abutted and embraced and to which the associated frame member may be tightly clamped. In addition, an elongated pull down chain is provided with a hook on one end for hook engagement through a horizontal bore formed through a corresponding frame member, an intermediate length portion of the pull down chain passes beneath a pulley journaled from the base and the base includes adjustment structure releasably and adjustably engageable with a selected link of the chain for exerting a strong pull thereon whereby the aforementioned associated frame portion may be pulled downwardly and outwardly into seated engagement with the clamp head against the spring suspension of the associated vehicle.

14 Claims, 2 Drawing Sheets

UNIVERSAL REPAIR RACK TRUCK TIE DOWN SYSTEM

BACKGROUND OF THE INVENTION

1. Field of the Invention

This invention relates to a stand for adjustable support from a vehicle rack and including adjustable features whereby the stand may be adjusted longitudinally of the rack as well as transversely thereof. In addition the stand is adjustable in height and includes an upper end head downwardly against which the lower margin of a truck frame rail may be abutted with the head embracingly engaging the frame rail. Further, the stand includes a tie down chain having hook structure on one end for hook engaging the associated truck frame rail in vertical alignment with the head of the stand and the other end of the chain is operatively associated with adjustment means for effecting a downward and outward pull on the chain, whereby the truck frame rail portion engaged by the hook structure may be pulled downward, against the upward force exerted thereon by the truck spring suspension system, into engagement with the head of the stand. In this manner, the truck frame is more rigidly supported from the stand. Further, the head at the upper end of the stand is pivotally supported therefrom in a manner such that the head may be fully abuttingly and embracingly engaged with an associated inclined truck frame portion.

2. Description of Related Art

Various different forms of support stands for vehicle repair racks heretofore have been provided. A previously known stand including substantially all of the basic features of the instant invention except for the pull down feature thereof is disclosed in my copending U.S. application Ser. No. 07/888,482, filed May 27, 1992, now U.S. Pat. No. 5,239,854. However, it has been found to be also beneficial when supporting a truck frame from a repair rack to have the truck frame pulled downwardly and outwardly against its suspension system to thereby not only more rigidly support the frame of the truck from the support stands provided therefor but to also increase the down loading of the wheels of the vehicle upon the repair rack.

SUMMARY OF THE INVENTION

The tie down system of the instant invention has been designed to enable a wheeled truck chassis to have the frame portion thereof rigidly supported from a repair rack with the frame of the truck or other vehicle pulled downwardly against the suspension system thereof whereby to provide a firm plane from which a datum can be established to measure and restore original factory dimensions.

With present day suspension systems, even on trucks, the ride, load carrying capacity and tire wear all are responsive to original specifications and if a frame is damaged and not restored to original factory dimensions the ride, load carrying capacity and tire wear all can be adversely effected. Accordingly, a need exists for structure by which a truck or other vehicle frame to be straightened may be fixedly supported from a repair rack in order that a firm plane from which a datum can be established to measure and restore original factory dimensions may be provided°

It is therefore the main object of this invention to provide a support stand which may be used (together with other similar support stands) for supporting a truck or other vehicle frame from a repair rack in a manner such that the frame has the supported portions thereof strongly pulled downward and outward against the suspension system of the vehicle and also firmly abutted against the adjusted height of the various associated support stands.

Another object of this invention is to provide a support stand in accordance with the preceding object and which may be adjusted both longitudinally and transversely of an associated vehicle repair rack.

Yet another object of this invention is to provide a support stand incorporating a frame pull down mechanism which may be readily used on substantially all vehicle frame members.

Another very important object Of this invention is to provide a support stand in accordance with the preceding objects and including upper head portions thereof which may be used in conjunction with either closed tubular box frame members or C-shaped frame members.

Another object of this invention is to provide a vehicle frame support stand including an upper end head for downwardly seatingly receiving an associated frame portion thereon and with the head pivotally mounted from the upper end of the adjustable height stand in order to enable the stand to be fully operatively associated with an inclined frame portion of an associated vehicle.

A final object of this invention to be specifically enumerated herein is to provide a vehicle frame support stand for use in conjunction with a repair rack and wherein the stand conforms to convention forms of manufacture, is of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
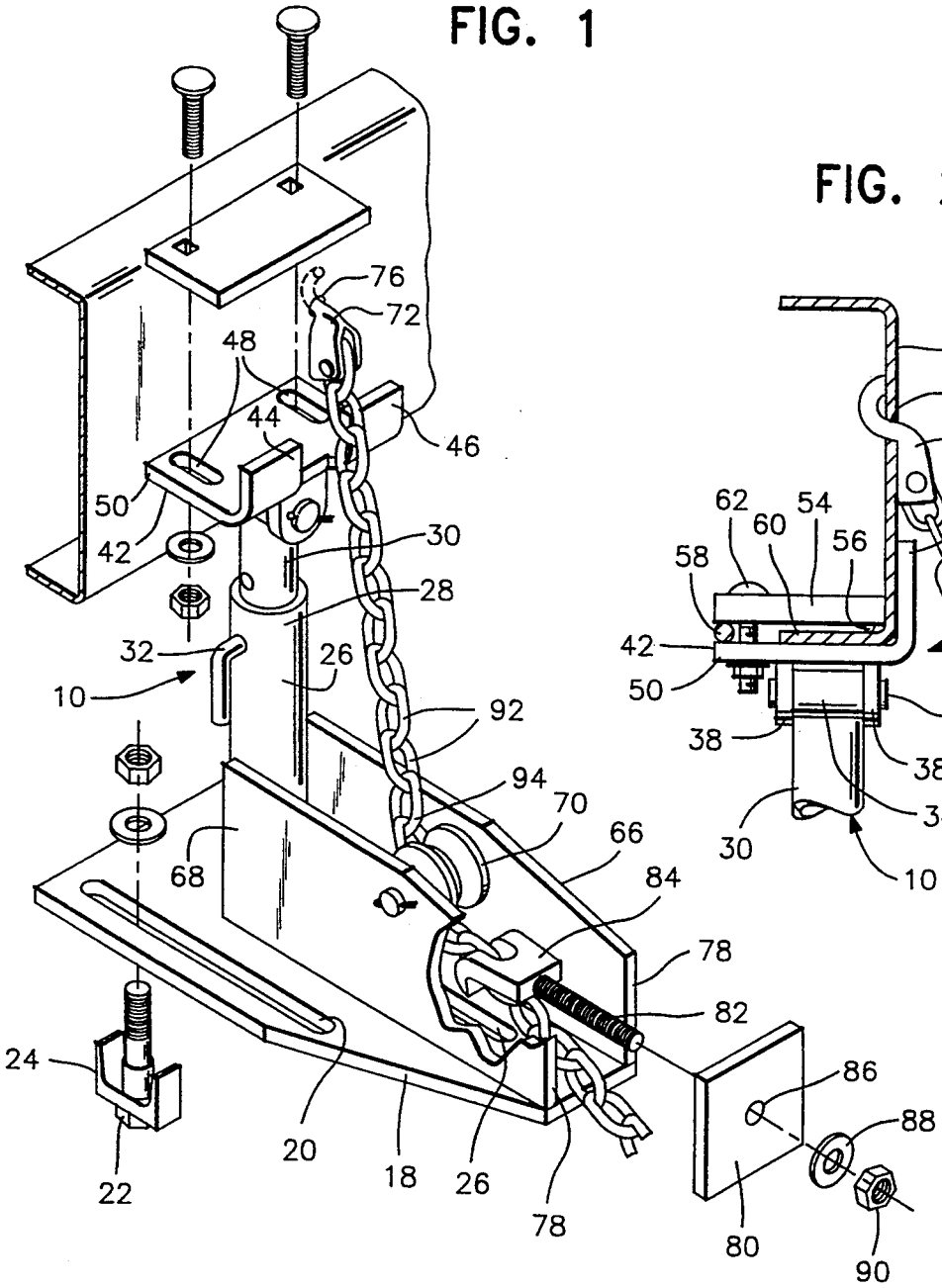
FIG. 1 is a perspective view of a support stand incorporating the tie down structure of the instant invention and with portions of the stand illustrated in exploded position, in operative association with a frame portion and with portions of the stand being broken away and illustrated in vertical section.

Referring now more specifically to the drawings the numeral 10 generally designates a support stand which is similar in some respects to the support stand disclosed in my prior U.S. application Ser. No. 07/888,482, filed May 27, 1992. The stand 10 defines a vehicle frame tie down structure for support and anchoring relative to a repair rack such as that generally designated by the reference numeral 12 in FIG. 3 comprising a support structure for the stand 10. The repair rack 12 has one of the opposite longitudinal side treadways 14 thereof illustrated in FIG. 3 incorporating a pair of relatively transversely braced inner and outer I-beam rails 15 and 16 which are laterally spaced apart and have a plurality of downwardly opening and laterally spaced apart channel members 17 disposed therebetween and braced relative to the I-beam rails 15 and 16. The upper surfaces of the I-beam rails 15 and 16 and the channel member 17 are coplanar and define an upwardly facing support surface upon which to anchor the lower base plate 18 of the stand 10. The base plate 18 is elongated transversely of the treadway 14 and includes opposite side longitudinal slots 20 by which anchor bolts 22 and T-heads 24 may be used to securely anchor the base plate 18 to the treadway 14 with the base plate 18 overlying the I-beam rails 15 and 16 as well as the channel members 17. In addition, the base plate 18 also includes a central longitudinal slot 26 which also may be used to anchor the base plate 18 to the channel members 17 through the utilization of anchor bolts 22 and T-heads or cross heads 24.

The stand 10 includes an upright 26 incorporating a lower end portion 28 abutted downwardly against and secured to the base plate 18 and an upper end portion 30 telescopingly engaged with the lower end portion 28 and adjustable in height relative thereto through the utilization of a removable latch pin 32 received through diametrically opposite radial bores formed in the lower end portion 28 and selected pairs of diametrically opposite radial bores formed in the upper end portion 30 and spaced longitudinally therealong.

The upper extremity of the upper end portion 30 includes a horizontal transverse sleeve 34 supported therefrom and a clamp head structure referred to in general by the reference numeral 36 is pivotally supported from the sleeve 34 through the utilization of apertured downwardly projecting mounting ears 38 of the head structure 36 and a pivot pin 40 removably secured through the ears 38 and the sleeve 40.

The clamp head structure 36 incorporates an angle member 42 having an intermediate length window 44 formed in its vertical flange portion 46 and a pair of transverse longitudinally spaced slots 48 formed in its horizontal flange portion 50.

Figure 2:
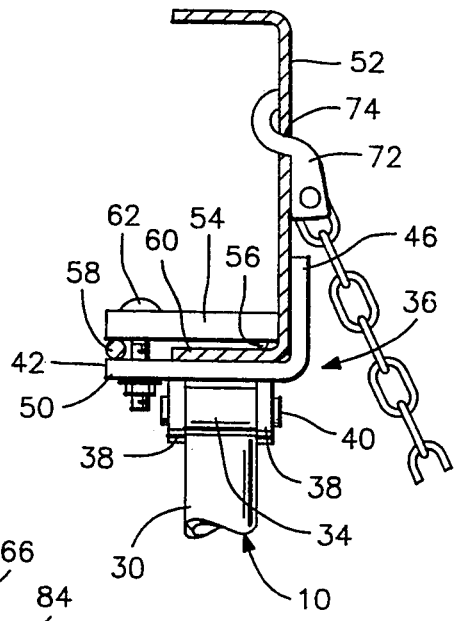
FIG. 2 is a vertical sectional view taken substantially upon a plane passing through the longitudinal center of the frame portion illustrated in FIG. 1 and with the upper portions of the stand illustrated in elevation and operatively associated with the frame portion.
Figure 4:
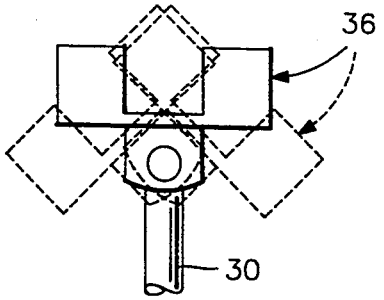
FIG. 4 is a side elevational view of the upper portion of the stand illustrated in FIGS. 1 and 2 illustrating the manner in which the head pivotally supported from the stand upper end may be variously inclined relative to the horizontal.

As may be seen from FIG. 2 of the drawings a C-shaped frame member 52 has its lower outside corner embracingly engaged in and downwardly abutted against the angle member 42 with a clamp plate 54 having downwardly projecting gripping members 56 spaced along its outer longitudinal margin and a spacing rod 58 secured to and Underlying its inner margin removably clamp engaged over the lower flange 60 of the frame member 52 through the utilization of threaded fasteners 62 removably secured downwardly through the clamp plate 54 and the horizontal flange portion 50 of the angle member 42.

In this manner, the lower margin of the C-shaped frame member 52 is securely downwardly abutted against and anchored relative to the angle member 42 of the stand 10 and the stand 10 is securely removably anchored relative to the I-beam rails 15 and 16 and the channel members 17.

It also will be noted from FIG. 1 of the drawings that the stand 10 includes a pair of upstanding opposite plates 66 and 68 having the lower margins welded to the base plate 18 and one pair of corresponding ends thereof abutted against and secured to opposite sides of the lower end portion 28 of the upright 26. In addition, the plates 66 and 68 journal a grooved pulley 70 therebetween midway between the opposite ends thereof and the midlength portion of a tension chain passes beneath the lower periphery of the pulley 70. One end of the chain includes a strong hook member 72 removably secured thereto and the hook member is constructed in a manner such that it may be releasably engaged through one of the numerous horizontal bores 76 which are conventionally formed through truck frame members and the like.

The ends of the plates 66 and 68 remote from the upright 26 have all but the lower portions of the vertical edges 78 thereof covered by a centrally apertured anchor plate 80 and the threaded shank 82 of a hook member 84 is secured through the central aperture 86 formed through the plate 80 by a washer 88 and nut 90.

It is to be understood that the hook member 84 may be removably engaged with any one of the links 92 of the chain 94 and that the nut 90 may be turned to thereby exert a pull on the chain 94 so as to tightly downwardly seat the frame member 52 on the clamp head structure 36.

It is to be noted that the effective height of the upright 26 will be adjusted such that the frame member 52 is pulled downwardly and outwardly from its normal position against the spring suspension system of the associated vehicle in order to be tightly seated and anchored relative to the clamp heads structure 36.

Figure 5:
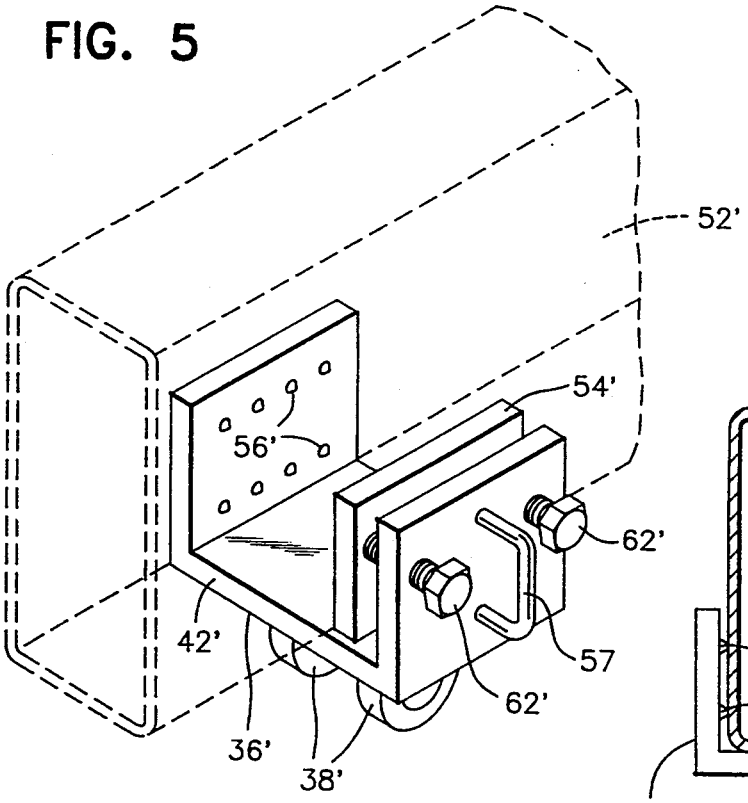
FIG. 5 is a perspective view of a modified form of stand upper end head specifically adapted to be used in conjunction with a box frame member.
Figure 6:
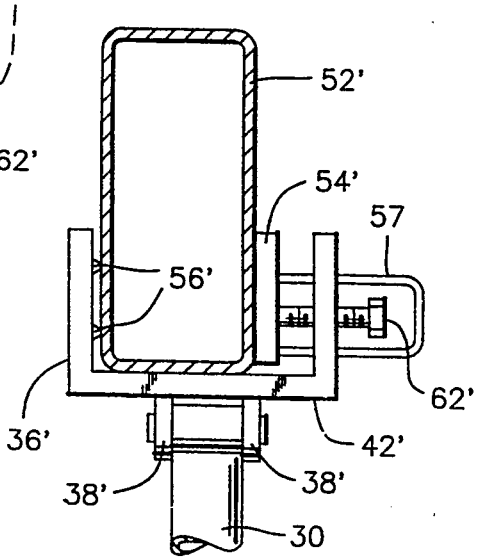
FIG. 6 is a transverse vertical sectional view of a box frame member with the head illustrated in FIG. 5 operatively associated therewith.

FIGS. 5 and 6 illustrate clamp head structure 36' which is similar to the clamp head structure 36 but is specifically designed to be used in conjunction with a box frame member 52'. The clamp head structure 36' incorporates a U-shaped channel member 42' equipped with frame member engaging projections 56' and a clamp plate 54' supported from the channel member 42' through the utilization of a U-shaped guide 57, clamp screws 62' being threaded engaged through the channel member 42 and abutted against the clamp plate 54. Of course, although not illustrated in FIGS. 5 and 6, the modified form of clamp head structure 36' also will be used in conjunction with hook members corresponding to the hook members 72 and 84 as well as a chain corresponding to the chain 94.

Figure 3:
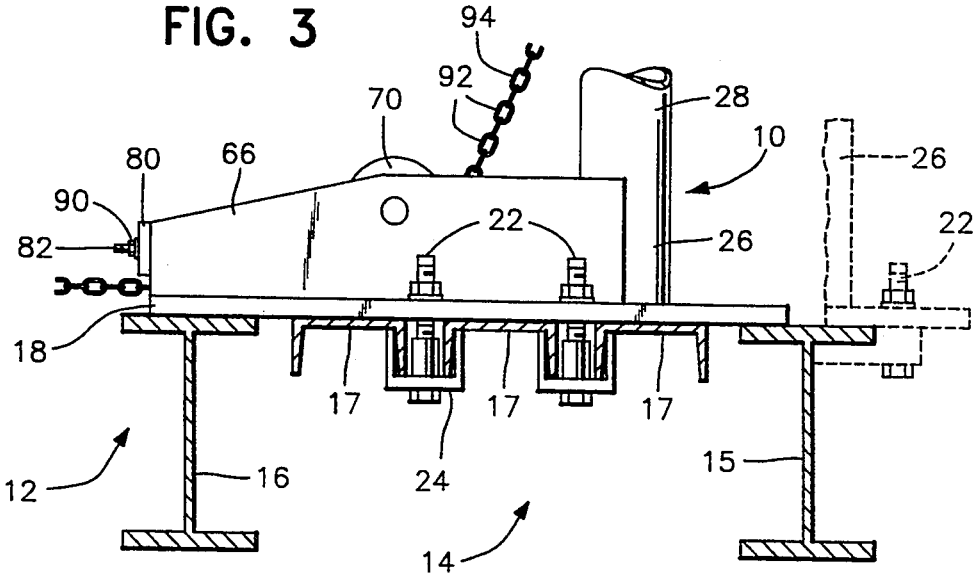
FIG. 3 is a transverse vertical sectional view of a portion of a vehicle repair rack and with the lower portion of the stand being illustrated in operative association with the support rack, a fragmentary inwardly shifted position of the support rack relative to the stand being illustrated in phantom lines.
Figure 7:
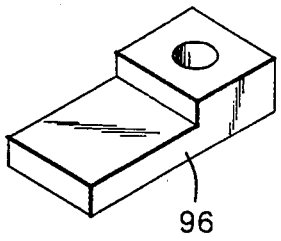
FIG. 7 is a perspective view of an additional hold down member for the stand to be used in conjunction therewith when the stand is inwardly transversely shifted relative to the repair rack to the phantom line position thereof illustrated in FIG. 3.

With attention now invited more specifically to FIGS. 3 and 7, if the vehicle frame is relatively narrow and it is found necessary to further inwardly shift the stand 10, the bolts 22 adjacent the upright 26 may be secured downwardly through a pair of adaptor blocks 96 such as that illustrated in FIG. 7 engaged with the inner side of the I-beam rail 15 in the manner shown in phantom lines in FIG. 3 while the other anchor bolt 22 and the corresponding T or cross head 24 may be utilized between the inner pair of channel members 17.

From FIGS. 1–3 of the drawings it will be seen that the chains of a plurality of stands 10 supporting a frame will be operative to exert downward and outward pull on associated vechicle frame portions. This not only securely anchors the frame to the rack against shifting in a vertical direction, but also secures the frame against even minimal shifting in a horizontal direction.

The foregoing is considered as illustrative only of the principles of the invention. Further, since numerous modifications and changes readily will occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a support structure defining upwardly facing support surface means, a vehicle frame tie down structure including a base disposed upon said support surface means and anchor means releasably engaged between said support structure and base anchoring said base to said support structure, said base including an upright stand having a lower end anchored relative to said base and an upper end from which a clamp head is supported for releasable clamped engagement with a vehicle frame portion, said clamp head including upwardly facing seating surface means downwardly against which a downwardly facing surface of said vehicle frame portion may be rigidly seated, and elongated pull down means having an upper end portion adapted for releasable anchoring to said vehicle frame portion and a lower end portion adjustably anchored relative to said base by adjustment means connected between said base and the lower end portion of said elongated pull down means operative to effect a controlled downward and outward pull on said upper end portion relative to said base, said clamp head including an angle member supported therefrom for embracingly and seatingly receiving therein the lower outer side portion of a C-shaped frame channel member, said angle member including horizontal base flange means and vertical flange means projecting upwardly from a first margin of said horizontal base flange means, said horizontal base flange means, along a margin thereof remote from and generally paralleling said vertical flange means, including an elongated, upwardly projecting spacer extending therealong, a horizontal clamp plate overlying and spanning the spacing between said spacer and vertical flange means, and clamp-type fastener means secured through said clamp plate and base flange means closely along the side of said spacer opposing said vertical flange means.

2. The combination of claim 1 wherein said elongated pull down means includes a heavy link chain.

3. The combination of claim 1 wherein said adjustment means includes a threaded connection adjustably anchoring said lower end portion to said base.

4. The combination of claim 1 wherein said pull down means upper end portion includes an anchor hook for hooked engagement through a horizontal bore formed through said vehicle frame portion.

5. The combination of claim 1 wherein said seating surface means defines a generally planar seating surface.

6. The combination of claim 5 wherein said clamp head is pivotally supported from said upper end portion for angular displacement relative to said stand about a horizontal axis generally paralleling said seating surface.

7. The combination of claim 1 wherein said anchor means includes means for anchoring said base to said support structure for adjustable shifting relative thereto in horizontal paths disposed normal to each other, said support structure being elongated and one of said paths extending longitudinally of said support structure.

8. In combination with a support structure defining upwardly facing support surface means, a vehicle frame tie down structure including a base disposed upon said support surface means and anchor means releasably engaged between said support structure and base anchoring said base to said support structure, said base including an upright stand having a lower end anchored relative to said base and an upper end from which a clamp head is supported for releasable clamped engagement with a vehicle frame portion, said clamp head including upwardly facing seating surface means downwardly against which a downwardly facing surface of said vehicle frame portion may be rigidly seated, and elongated pull down means having an upper end portion adapted for releasable anchoring to said vehicle frame portion and a lower end portion adjustably anchored relative to said base by adjustment means connected between said base and the lower end portion of said elongated pull down means operative to effect a controlled downward and outward pull on said upper end portion relative to said base, said clamp head including an upwardly opening channel member for embracingly receiving therein the lower portion of a box frame member, said channel member including a clamp plate adjustably supported therefrom between opposite sides of said channel member and for movement toward and away from one of said sides.

9. The combination of claim 8 wherein said clamp head is pivotally supported from said upper end portion for angular displacement relative to said stand about a horizontal axis generally paralleling said seating surface.

10. The combination of claim 9 wherein said pull down means upper end portion includes an anchor hook for hooked engagement through a horizontal bore formed through said vehicle frame portion.

11. In combination with a support structure defining upwardly facing support surface means, a vehicle frame tie down structure including a base disposed upon said support surface means and anchor means releasably engaged between said support structure and base anchoring said base to said support structure, said base including an upright stand having a lower end anchored relative to said base and an upper end from which a clamp head is supported for releasable clamped engagement with a vehicle frame portion, said clamp head including upwardly facing seating surface means downwardly against which a downwardly facing surface of said vehicle frame portion may be rigidly seated, and elongated pull down means having an upper end portion adapted for releasable anchoring to said vehicle frame portion and a lower end portion adjustably anchored relative to said base by adjustment means connected between said base and the lower end portion of said elongated pull down means operative to effect a controlled downward and outward pull on said upper end portion relative to said base, said base being elongated and said stand being supported from one end of said base, said base including a pair of elongated upstanding support plates mounted therefrom with said stand secured between one pair of corresponding ends of said support plates, a pulley disposed between and journaled from intermediate length portions of said support plates and beneath which an intermediate length portion of said elongated pull down means is trained, said adjustment means being carried by the other ends of said support plates.

12. The combination of claim 11 wherein said elongated pull down means includes a heavy link chain.

13. The combination of claim 11 wherein said clamp head is pivotally supported from said upper end portion for angular displacement relative to said stand about a horizontal axis generally paralleling said seating surface.

14. The combination of claim 11 wherein said adjustment means includes a threaded connection adjustably anchoring said lower end portion to said base.

* * * * *